United States Patent [19]

Konesky

[11] 4,287,898

[45] Sep. 8, 1981

[54] HAIR COMB

[76] Inventor: Leo L. Konesky, #4 Verona St., Villa Capri, Rio Piedras, P.R. 00924

[21] Appl. No.: 57,395

[22] Filed: Jul. 13, 1979

[51] Int. Cl.[3] ..... A45D 24/00

[52] U.S. Cl. ..... 132/11 R; 132/141; 132/142

[58] Field of Search ..... 132/11 R, 132–134, 132/126, 159, 161, 137, 143, 141–142

[56] References Cited

U.S. PATENT DOCUMENTS

| | | | |
|---|---|---|---|
| 430,678 | 8/1909 | Moore | 132/142 |
| 655,666 | 8/1900 | Wolff | 132/161 |
| 1,621,269 | 3/1927 | Pickford | 132/142 |
| 1,671,094 | 5/1928 | Widdows | 132/161 X |
| 1,880,619 | 10/1932 | Wildey | 132/137 X |
| 2,626,618 | 1/1953 | Collison | 132/137 X |
| 2,909,183 | 10/1959 | Golden | 132/141 |
| 3,792,707 | 2/1974 | Tupper | 132/11 R |
| 3,797,506 | 3/1974 | Reinsch | 132/137 |

FOREIGN PATENT DOCUMENTS

| | | | |
|---|---|---|---|
| 615858 | 1/1927 | France | 132/132 |

*Primary Examiner*—G. E. McNeill

*Attorney, Agent, or Firm*—Scrivener, Clarke, Scrivener and Johnson

[57] ABSTRACT

The disclosure is of a comb to be used for fluff combing hair.

1 Claim, 4 Drawing Figures

HAIR COMB

BACKGROUND OF THE INVENTION

While a great variety of comb constructions, having many different tooth configurations and arrangements have been proposed and provided in the prior art, it has been the object of this invention to provide a comb having teeth of improved construction, arrangement and relation to other teeth of the comb whereby use of this comb in normal combing of the hair will not produce compression of the hair but will enhance the fullness and fluffiness thereof.

SUMMARY OF THE INVENTION

The comb provided by the invention has three parallel rows of teeth, the teeth of the side rows being laterally aligned and those of the middle row being offset with respect to them, all of the teeth having a longitudinal compound curvature in the same directions, all teeth having an elliptical cross-sectional shape with the major axis in the direction of normal comb movement, and the teeth of the side rows being shorter than the adjacent teeth of the middle row.

DESCRIPTION OF THE INVENTION

Figure 1:
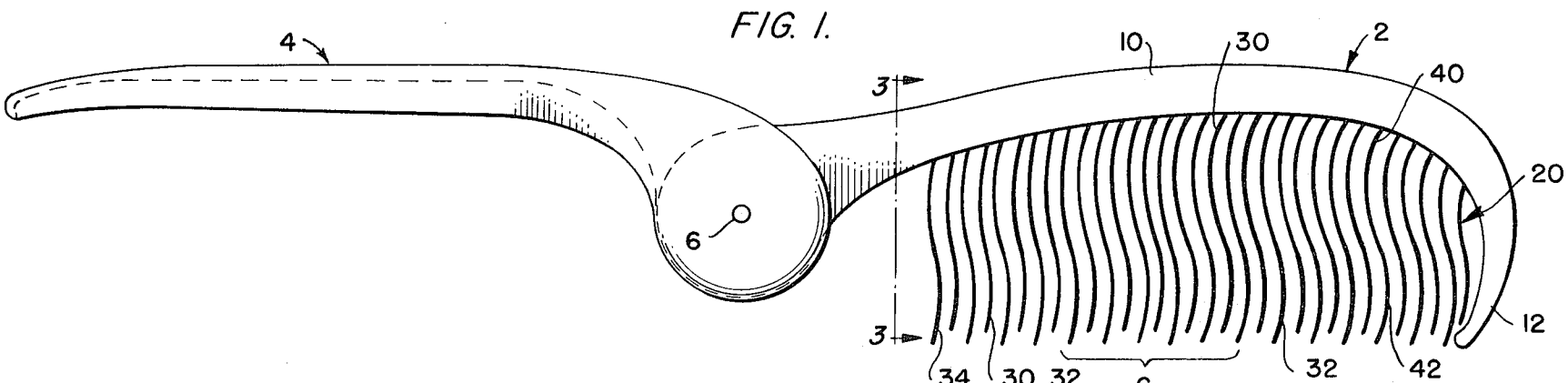
FIG. 1 is a side elevational view of a two-part, foldable comb as provided by the invention, in open position.
Figure 4:
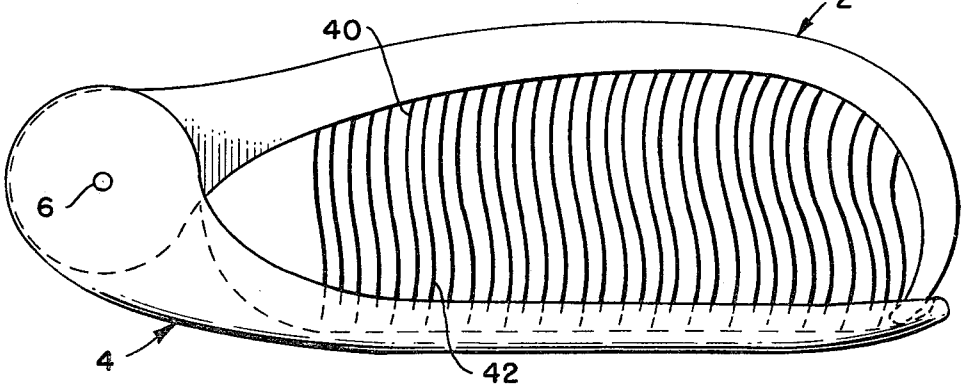
FIG. 4 is a side elevational view showing the embodiment of FIG. 1 in closed position.

The invention is disclosed in this specification as embodied in a foldable comb which comprises a comb part 2 and a cover part 4 which are pivotally connected at their adjacent end by a pin or other means 6 so that the comb may be opened as shown in FIG. 1 for use in combing the hair or the cover part may be moved to closed position as shown in FIG. 4 for carrying in the pocket or a vanity case. It will be understood that the cover part 4 may be eliminated without departing in any way from the invention.

Figure 2:
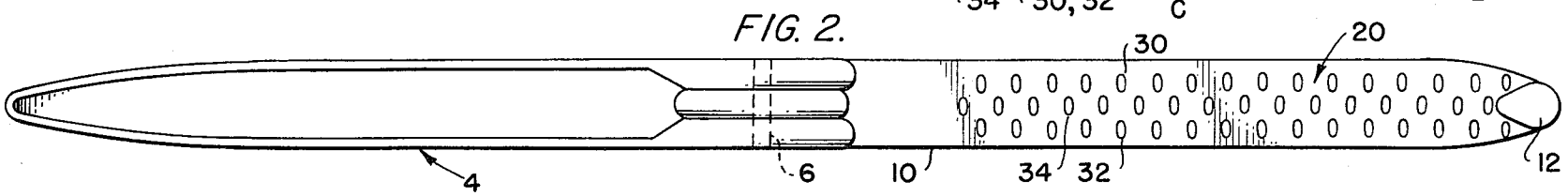
FIG. 2 is a bottom plan view of the comb.

The comb comprises an elongated backing part 10 which may have a downwardly curved part 12 at its outer end, and teeth which are denoted generally at 20 and which extend in general parallelism to each other from the backing member. The teeth are arranged in three parallel rows, these being the two outer, or side, rows 30, 32 and a single central, or middle, row 34. The teeth of the side rows are aligned in the direction of normal combing movement, which is transverse with respect to the length of the backing member 10, and each tooth of the middle row is positioned between the two adjacent teeth of the two side rows, as clearly shown in FIG. 2.

Each tooth of the comb has an elliptical cross-sectional shape throughout at least the major part of its length, with the major axis of the ellipse in the direction of normal combing movement, which is transverse with respect to the length of the backing member 10.

Each tooth of the comb has a compound curvature from end to end, and the curvatures are such that the teeth are substantially parallel to each other throughout their length. Thus, as shown in FIG. 1, each tooth has a sine-wave curvature with oppositely directed curves 40, 42 and all other teeth have corresponding curves at corresponding parts thereof.

Figure 3:
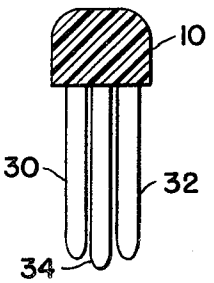
FIG. 3 is a cross-sectional view taken on line 3—3 of FIG. 1.

In accordance with the invention each tooth of the two side rows 30, 32 is shorter than the adjacent teeth of the middle row 34, as clearly illustrated in FIGS. 1 and 3. I have found that best results are achieved when the teeth of the side rows are approximately 3/16 inch shorter than the adjacent teeth of the middle row, and the teeth of the middle row are from $1\frac{1}{2}$ to $2\frac{1}{2}$ inches in straight line length. It will be understood that if the backing member 10 is curved from end to end, as it is shown in FIG. 1, the straight-line length of the teeth at the ends of the backing member will be less than that of the teeth at the center part of the backing member, but the length relations of the teeth of the side and middle rows will remain throughout the length of the comb. Thus, if the backing is straight all of the teeth of the middle row will be of the same length, which may be from $1\frac{1}{2}$ to $2\frac{1}{2}$ inches, and all of the teeth of the two side rows will be of the same length, which will be 3/16 inch shorter than the length of the teeth of the middle row, while if the backing is outwardly curved, as in FIG. 1, the teeth of the middle row will be at least $1\frac{1}{2}$ inches in length at the ends of the comb and will increase in length to a maximum of $2\frac{1}{2}$ inches at the center. In any case the free ends of the teeth of the middle row lie in a straight line and the teeth of the two side rows lie in a plane spaced inwardly of the straight line.

In further accordance with the invention I have found that best results are provided if the spacing between the middle and side rows of teeth is approximately 2/16 inch in the direction of the longitudinal length of the comb.

I claim:

1. A comb for use in combing the human hair, comprising a single elongated backing member and teeth formed integrally with the backing member and extending in the same direction therefrom, (a) the teeth being arranged in three parallel rows which extend substantially from end to end of the backing member, (b) each of the teeth being shaped in a compound curve from end to end and the curvatures of all of the teeth being in the same direction whereby the teeth are substantially parallel, (c) the spacing of the teeth longitudinally of the backing member being the same in each row and in all three rows, (d) the teeth of the two side rows being aligned transversely of the backing member and the teeth of the middle row being positioned longitudinally of the comb midway between those of the side rows, (e) all of the teeth being of the same cross sectional size and elliptical cross-sectional shape with the major axis of the ellipse being transverse of the backing member, (f) the free ends of the teeth of the middle row lying in a straight line extending longitudinally of the comb, and (g) the free ends of the teeth of the two side rows lying in a common plane which is spaced toward the backing member from the straight line of the ends of the teeth of the middle row.

* * * * *